US007374444B1

(12) United States Patent
Bennett

(10) Patent No.: US 7,374,444 B1
(45) Date of Patent: May 20, 2008

(54) MULTIFUNCTIONAL CONSTRUCTION MOLDING WITH INTEGRATED ELECTRICAL INTERCONNECT AND OUTLET

(75) Inventor: Barton E Bennett, Mishawaka, IN (US)

(73) Assignee: Odyssian Technology, LLC, Mishawaka, IN (US)

( * ) Notice: Subject to any disclaimer, the term of this patent is extended or adjusted under 35 U.S.C. 154(b) by 284 days.

(21) Appl. No.: 10/990,849

(22) Filed: Nov. 17, 2004

Related U.S. Application Data

(60) Provisional application No. 60/520,705, filed on Nov. 17, 2003.

(51) Int. Cl.
*H01R 4/60* (2006.01)

(52) U.S. Cl. ..... 439/215

(58) Field of Classification Search ..... 439/215, 439/94, 110–122, 207–212, 100, 351–352, 439/358

See application file for complete search history.

(56) References Cited

U.S. PATENT DOCUMENTS 4,313,646 A * 2/1982 Millhimes et al. ..... 439/654
4,547,030 A 10/1985 Tanner et al.
4,646,211 A 2/1987 Gallant et al.
5,052,937 A 10/1991 Glen
5,183,406 A 2/1993 Glen
5,336,097 A * 8/1994 Williamson et al. ..... 439/94
6,036,516 A * 3/2000 Byrne ..... 439/215
6,039,584 A 3/2000 Ross ..... 439/115
6,105,741 A 8/2000 Ross ..... 191/23 A
6,296,498 B1 10/2001 Ross ..... 439/115
6,517,363 B2 2/2003 Ross ..... 439/115
6,521,837 B2 2/2003 Hilgert et al. ..... 174/99 B
6,644,988 B2 11/2003 Healy
6,805,226 B1 10/2004 Ross et al. ..... 191/45 A
7,204,714 B2 * 4/2007 Walker et al. ..... 439/532

* cited by examiner

*Primary Examiner*—Edwin A. Leon
(74) *Attorney, Agent, or Firm*—Baker & Daniels LLP

(57) ABSTRACT

An electrical distribution system that in one embodiment includes a structural or trim member having a slot, the slot including at least two continuous electrical conductors, each having an exposed electrical contact surface and separated from one another by a dielectric material. The electrical distribution system may also include a plug-in outlet receptacle including at least one set of receiving apertures, for receiving an electrical plug and at least two electrical contactors electrically connected to respective apertures for providing electrical power to a device plugged into the outlet receptacle, wherein the contactors are configured for receipt into the slot, and further configured so that when plugged therein one of the contactors makes electrical contact with one of the continuous conductors, and the other contactor makes electrical contact with the other continuous conductor.

27 Claims, 15 Drawing Sheets

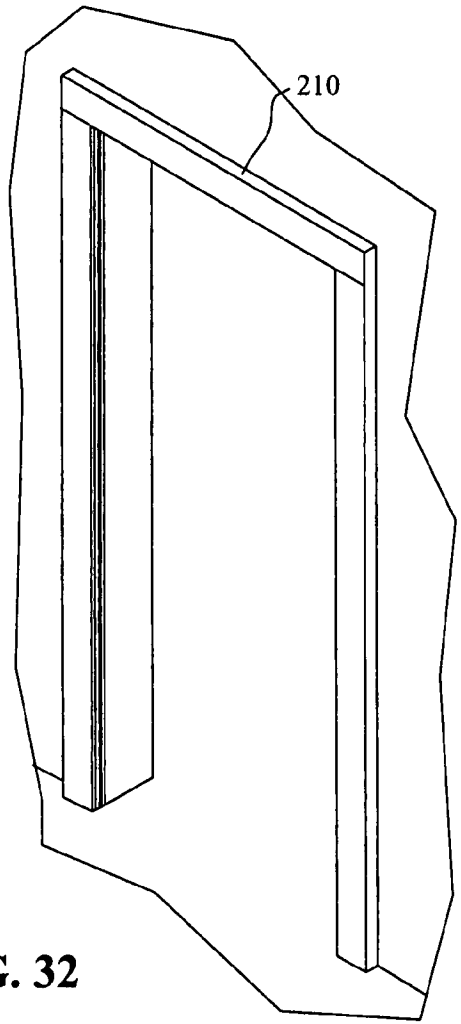
FIG. 32
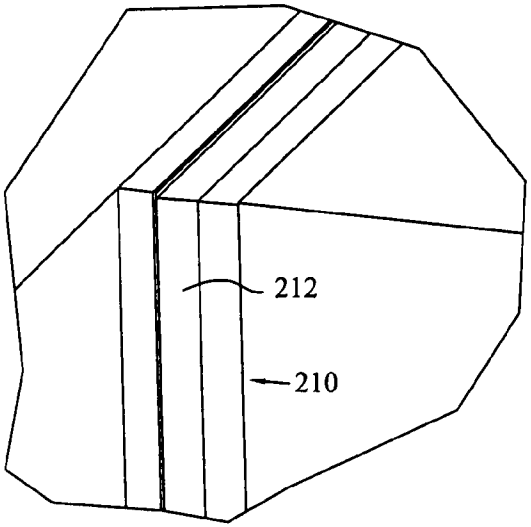
FIG. 33
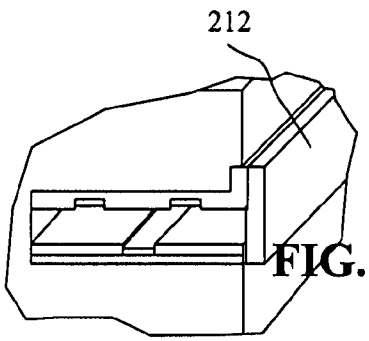
FIG. 34
FIG. 32

MULTIFUNCTIONAL CONSTRUCTION MOLDING WITH INTEGRATED ELECTRICAL INTERCONNECT AND OUTLET

This application claims the benefit of U.S. Provisional Patent Application Ser. No. 60/520,705 filed Nov. 17, 2003, the complete disclosure of which is hereby expressly incorporated by reference.

BACKGROUND OF THE INVENTION

This invention relates to a board construction having an integrated electrical interconnect and outlet system, and in particular, to a board/construction allowing for electrical outlet access and receptacle connection continuously along the length thereof.

Typical room construction in both residential and commercial buildings provides one or more discreet outlets for plugging in electrical appliances, lights and such. Standard outlet designs correspond to specific supplied voltage ranges. Often, electrical outlets are wall mounted and provide a single location for connection with single or multiple female electrical connections per discreet outlet location. Wall outlets are typically mounted near the floor and above the baseboard with electrical conduits providing power to the outlet and being circumvented through the building walls to a power source. Electrical or electronic devices with male electrical connections are plugged into the discreetly located electrical outlets. The electrical outlet connection to electrical or electronic devices provides electricity to the device for the purpose of providing power, signal or monitoring. Electrical circuit protection and conditioning devices are typically provided at the central electrical power box, at the discreetly located electrical wall mount, or on an electrical corded outlet extension. Such protection and conditioning devices provide fuse, switching, filtering or other means of preventing excessive electrical current, current spiking, or undesirable current fluctuation. It is also known to provide electrical outlets as electrically corded outlet extensions, commonly referred to as power strips or extension cords. Such power strips have a cord with a plug for plugging into one of the wall outlets and includes a plurality of electrical outlets on a strip.

Such designs are limited in that the location of the outlet may be inconvenient or require running an electrical cord across parts of the room where it may become a trip hazard. In addition, the placement of the electrical outlets may be a hindrance to locating furniture and other objects in the room wherein their placement may cover the electrical outlet.

It is also known to provide construction boarding or molding in various forms including what is commonly referred to as floorboards, floor molding, chair rails, crown molding, ceiling molding, or protection boarding. These construction boards are typically wall mounted to protect the wall from scratches, scuff markings, and damage, and to provide decoration and aesthetic appeal, as well as to ease construction in flooring installation by allowing for irregular or imprecise cuts that are later covered by the board.

Accordingly, it is desirous to provide electrical outlets that provide greater versatility and increased locations throughout a room for receiving an electrical plug as opposed to a few discreet locations as is now common. One suitable way for providing outlets with increased versatility and more plug-in locations is to provide such outlets in the construction boarding or molding in a room. One such electrical outlet is shown in U.S. Pat. No. 4,646,211 to Gallant et al., which is incorporated herein by reference. Gallant discloses a service wall outlet having an elongated housing configured to conceal and protect an electrical service conduit. The service outlets are movable along linear sections of the housing to permit placement of the service outlet at different positions along the linear sections. The service outlets can be repositioned while still maintaining the conduits in a concealed and protected position.

Another electrical system providing repositioning capabilities for an electrical outlet is disclosed in U.S. Pat. Nos. 5,052,937 and 5,183,406, both to Glen, which are incorporated herein by reference. Glen discloses a movable electrical receptacle that provides conductors that are placed in a way to try to avoid human contact. The system in Glen utilizes a T-shaped element which is inserted through a groove at the end of a baseboard and can be moved there along to contact continuous conductors with the outlet being mounted with screws at a desired location along the baseboard. Glen also discloses that the system may be used to provide coaxial cable and telephone outlet jacks.

Another baseboard electrical outlet system is disclosed in U.S. Pat. No. 6,644,988 to Healy. Healy offers an advantage over the disclosures in Gallant and Glen in that it does not require repositioning of discreet outlets along the baseboard. The electrical installation in Healy utilizes three parallel grooves having continuous electrical conductors contained therein for receiving an electrical plug in any position along the length of the baseboard.

An object of the invention, therefore, is to provide an electrical system integrated into construction boarding or molding that allows for electrical outlet access and receptacle connection continuously along the length of the board. Receptacle connection may be provided by direct connection with outlet slots that run the length of the board or by plugging into outlet receptacles that may be plugged in to receiving slots along the length of the board. Such outlet slots provide connection to positive voltage, negative voltage, and common ground. Also, it would be desirable to provide power termination and junction devices including electrical termination brackets or flexible jumpers and electrical power source junction terminations to allow for electrical coupling of separate adjacent multifunctional electrical construction boards and the integration of circuit protection in control devices. Electrical power source junction terminations may provide for connection of single or multiple electrical construction boards to an electrical power source and common grounding. Such a system allows multiple electrical devices to be plugged in anywhere along the periphery of a room where the electrical construction board is placed. These and other objects of invention have been provided in embodiments of the present invention.

SUMMARY OF THE INVENTION

It is a feature of the invention to provide an electrical distribution system that in one embodiment includes a structural or trim member having a slot, the slot including at least two continuous electrical conductors, each having an exposed electrical contact surface and separated from one another by a dielectric material. The electrical distribution system may also include a plug-in outlet receptacle including at least one set of receiving apertures, for receiving an electrical plug and at least two electrical contactors electrically connected to respective apertures for providing electrical power to a device plugged into the outlet receptacle, wherein the contactors are configured for receipt into the slot, and further configured so that when plugged therein one of the contactors makes electrical contact with one of the continuous conductors, and the other contactor makes electrical contact with the other continuous conductor.

The conductors of the electrical distribution system may extend along opposite sides of the slot. The electrical distribution system may include three conductors with two on one side of the slot and one on the other side of the slot.

The contactors of the plug-in outlet receptacle of the electrical distribution system can be plugged into the slot at any desired location along the length thereof. The slot may include three conductors.

The electrical distribution system may include a corner electrical connector for plugging into the slots of two adjacent structural/trim members for providing an electrical connection therebetween.

The contactors of the electrical distribution system may be mounted on a dielectric material that is attached to the outlet receptacle. The contactors may be parallel to one another and extend in a direction parallel to the conductors in the slot when plugged therein.

The structural or trim member is selected from a group consisting of a baseboard, a chair rail, a window or door molding/frame, a modular wall, a mantle, a railing, a furniture unit or a structural wall.

It is another feature of the invention to provide an embodiment of an electrical distribution system that includes at least one structural or trim number having a slot with at least two conductors mounted therein, the conductors having a contact surface and spaced apart by a dielectric material; and a plug-in outlet receptacle having at least one set of receiving apertures for receiving an electrical plug and at least two contactors electrically connected to respective apertures to provide electrical power to a device plugged therein, said contactors configured to be plugged in said slot so that one contactor makes electrical contact with one conductor, and the other contactor makes electrical contact with the other conductor. The plug-in outlet receptacle can be moved along the length of the slot to obtain electrical contact while plugged in at different locations along the length therein.

The electrical distribution system may include a power control module remotely controlling the electrical power to the outlet receptacle.

The electrical distribution system may include three conductors with two conductors located on one side of the slot and one conductor located on the opposite side of the slot.

The electrical distribution system may include at least three structural or trim members with one of the structural or trim members being a connection member to electrically connect the other two structural/trim members to one another. The slot of the connection member can be filled with a dielectric material. The slot of the connection member may also have a cover mounted thereover.

It is also a feature of the invention to provide an embodiment of an electrical distribution system that includes a structural or trim member with a slot therein and at least two conductors mounted therein, the conductors each having a contact surface and spaced apart by a dielectric material; and a plug-in outlet receptacle having at least one set of receiving apertures for receiving an electrical plug from a device to be plugged therein, and at least two contactors electrically connected to respective apertures to provide electrical power thereto. The contactors may be mounted on a dielectric material that is configured to be plugged in and received in the slot so that one contactor makes electrical contact with one conductor, and the other contactor makes electrical contact with the other conductor.

The electrical distribution system may include three conductors and three contactors. One of the conductors may be mounted along an opposite side of the slot from the other two conductors.

The contactors of the electrical distribution system may be mounted generally parallel to one another on the dielectric material and extend in a direction generally parallel to the conductors in the slot when plugged therein.

The electrical distribution system may include a power control module to remotely control power to said outlet receptacle.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein:

FIG. 32 is a perspective view of a structural/trim member similar to FIG. 26; except with a sealing cover, and shown mounted about a door opening;

FIG. 33 is a close-up view of a corner of the structural/trim member and door opening of FIG. 32;

FIG. 34 is a side perspective view of the structural/trim member of FIGS. 32 and 33 with a sealing cover;

Figure 3:
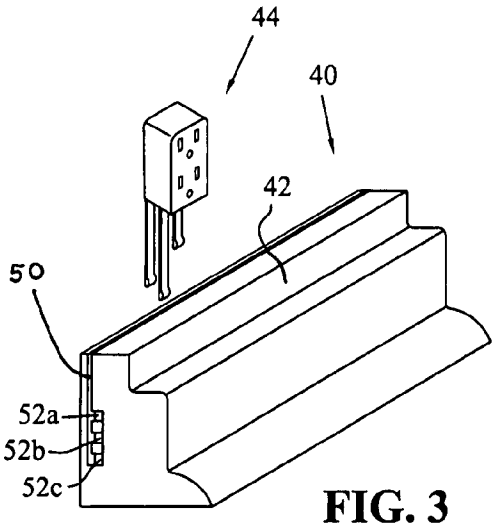
FIG. 3 is an embodiment of the present invention including a baseboard with a single slot having three separate continuous conductors and an outlet plug receptacle for plugging into the slot to make electrical connection with the conductors.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention, in several forms, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

Figure 1:
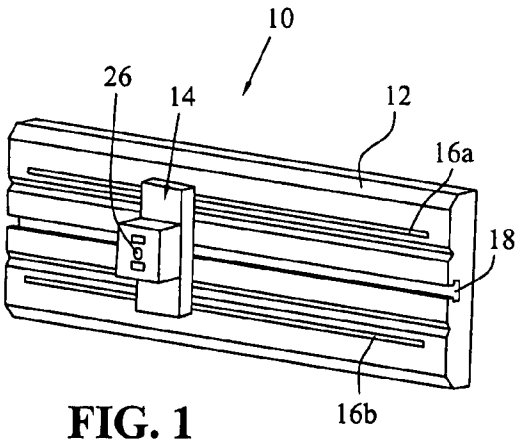
FIG. 1 is a perspective view of a relocatable outlet mounted on a baseboard having two continuous electrical conductors set in separate slots.
Figure 5:
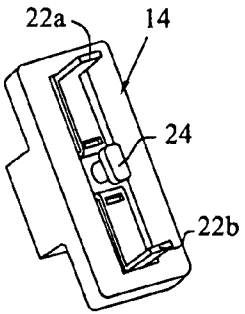
FIG. 5 is a rear perspective view of the outlet used in FIG. 1.
Figure 4:
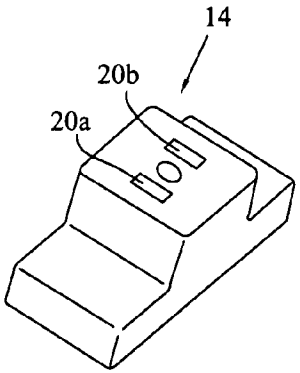
FIG. 4 is a front perspective view of the outlet of FIG. 1.

Referring now to FIGS. 1, 4 and 5, a multifunctional electrical distribution construction board system is generally indicated as 10. Electrical distribution board system 10 includes a baseboard or other structural or trim member 12, and a plug-in electrical outlet receptacle, generally indicated as 14. Baseboard 12 includes a pair of slots 16*a*, 16*b*, that have electrical conductors, as is well known in the art, such as copper wiring or strips, mounted therein, which are mounted along the lengths of the slots to form continuous conductors. Baseboard 12 also includes a T-shaped mounting groove 18.

Outlet receptacle 14 includes a pair of apertures 20*a*, 20*b*, for receipt of an electrical plug (not shown), as is well known, for powering a device (not shown) from electrical distribution board system 10. However, receptacle 14 also includes a pair of contactors 22*a*, 22*b*, as best shown in FIG. 5, for contacting with the respective conductors in slots 16*a*, 16*b*. Electrical outlet receptacle 14 also includes a rotatable mounting lug 24, for securing the outlet receptacle to T-shaped mounting groove 18. Rotatable mounting lug 24 has a width that is less than the narrowest width of mounting groove 18, and a length that is longer than the narrowest width of groove 18, but less than the widest base portion of the groove. This enables outlet receptacle 14 to be attached to baseboard 12 by inserting the mounting lug into groove 18 and then rotating a screw 26 (FIG. 1) attached to the lug so that the lug rotates and is held by T-shaped mounting groove 18. As should be appreciated, outlet receptacle 14 may be moved anywhere along the baseboard 12, wherein contactors 22*a*, 22*b* are in contact with respective conductors in slots 16*a*, 16*b*.

Figure 2:
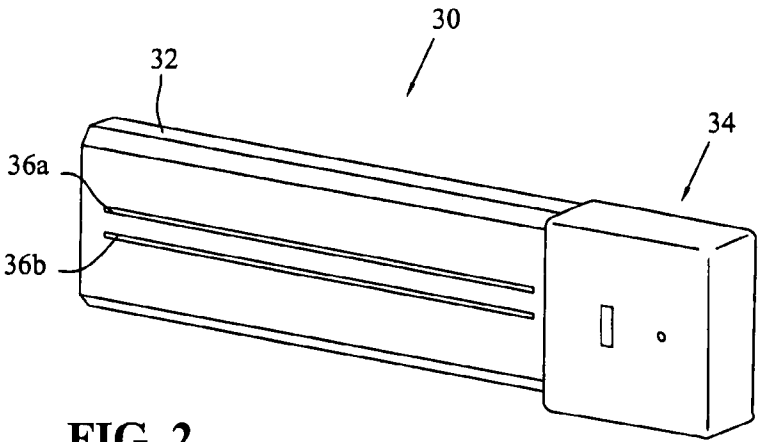
FIG. 2 is a perspective view of a baseboard having two continuous slots for receipt of the two-pronged electrical plug and including a power control module.

Another multifunctional electrical distribution board system is shown in FIG. 2, and generally indicated as 30. Electrical distribution board system 30 includes a baseboard or other structural or trim member 32 and a power control module generally indicated as 34. Baseboard 32 includes slots 36*a*, 36*b* having conductors therein similar to slots 16*a*, 16*b*, except that they are spaced closer together for receipt of standard two-prong electrical plug (not shown) for powering a device (not shown) attached thereto. Power control module 34 is of a type known in the art and can be used for controlling electrical power to the conductors in slots 36*a*, 36*b*. The power control module may be operated remotely from a mounted wall control or hand-held unit. A connection between the controller and power control module may be an electrical connection, radio frequency or infrared, as are known. Power control module 34 may also include ground fault electronics and prevent power surges or voltage spikes, as is known, in conductors 36*a*, 36*b*. An infra red receiver may also be placed in an outlet receptacle for individualized control of the receptacle.

Figure 6:
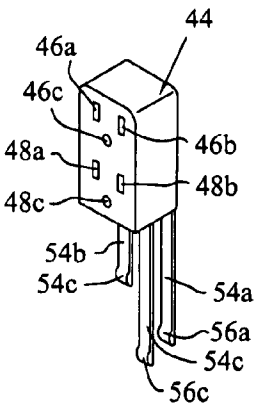
FIG. 6 is a perspective view of the plug used with the baseboard in FIG. 3.

Referring now to FIGS. 2 and 6, another multifunctional electrical distribution board system is shown generally indicated as 40. Distribution board system 40 includes a baseboard or other structural or trim member 42, and a plug-in electrical outlet receptacle generally indicated as 44. Outlet receptacle 44 includes two sets of apertures 46*a*, 46*b*, 46*c*, and 48*a*, 48*b*, 48*c* configured to receive standard three-prong electrical plugs (not shown).

Baseboard 42 of electrical distribution board system 40 includes a single slot 50 that is located toward the upper portion of the baseboard and is vertically oriented in this embodiment. Slot 50 extends the length of baseboard 42 and includes three electrical conductors 52*a*, 52*b*, 52*c*, located along one side of the slot and running the length thereof. The electrical conductors are made from a known conductible material, such as copper, can run generally parallel to one another, and are separated by a dielectric material, such as an ABS plastic lining the slot.

Plug-in outlet receptacle 44 includes three contactors 54*a*, 54*b*, 54*c*, extending downward therefrom, which are configured to be received in/plugged into slot 50. The contactors are made from a somewhat flexible conductive material, such as copper or aluminum, and may include respective contact prongs 56*a*, 56*b*, 56*c* at the ends thereof. The prongs may be manufactured by folding a portion of the contactors back over to provide a resilient contact area. The contactors 54*a*, 54*b*, 54*c* are configured in an unequal length so that, when plugged into slot 50, prongs 56*a*, 56*b*, 56*c* contact respective conductors 52*a*, 52*b*, 52*c*. Additionally, the width of the prongs is designed to provide a snug compression fit when inserted into slot 50. It should be appreciated that plug-in receptacle 44 may be plugged into slot 50 anywhere along the length thereof at the desired location, where the apertures will be accessible to the plug on the cord of the device (not shown) to be powered therefrom. Also, more than one outlet receptacle 44 may be plugged in along the length of slot 50.

Another embodiment of a multifunctional electrical distribution board system is generally indicated as 60 in FIGS. 7-10 and 18. In the embodiment shown, electrical distribution board system 60 includes a chair rail or other structural or trim member 62 and a plug-in outlet receptacle generally indicated as 64. Chair rail 62 includes a main face member 64, a back member 66, and a slot generally indicated as 68. Face member 64 has a rounded front, which will serve as the visible portion of the chair rail and a notch 70 in the lower back portion, where slot 68 is located. Slot 68 is formed from a front member 72, a rear member 74, and an upper member 76. Slot members 72, 74, and 76 are formed from a dielectric material, such as ABS plastic, or may be covered or partially covered with a dielectric nonconductive coating. In the embodiment shown, front member 72 of slot 68 includes two parallel longitudinally extending grooves 78*a*, 78*b*, and rear member 74 includes a single longitudinal groove 80. Slot 68 also includes conductors 82*a*, 82*b*, 82*c* received in respective grooves 78*a*, 78*b*, 80. The conductors are made from electrical conductive material, such as copper or aluminum, and may be press-fit, adhered, fastened, or extruded in the longitudinal grooves.

Figure 15:
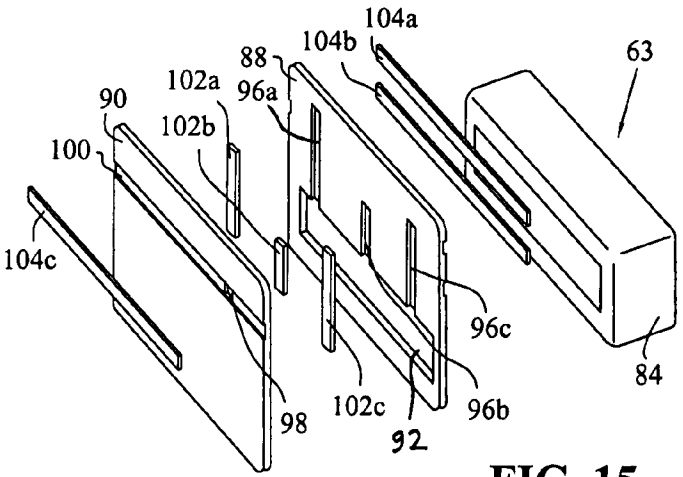
FIG. 15 is an exploded rear perspective view of the outlet of FIG. 11.
Figure 13:
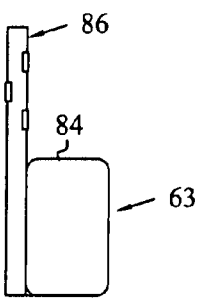
FIG. 13 is a side view of the outlet plug of FIG. 11.
Figure 11:
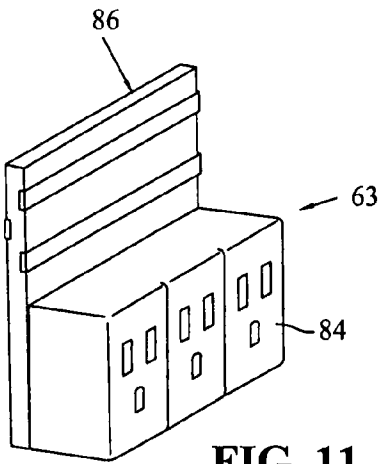
FIG. 11 is a perspective view of the outlet plug of the embodiment of FIG. 7 removed from the chair rail.
Figure 14:
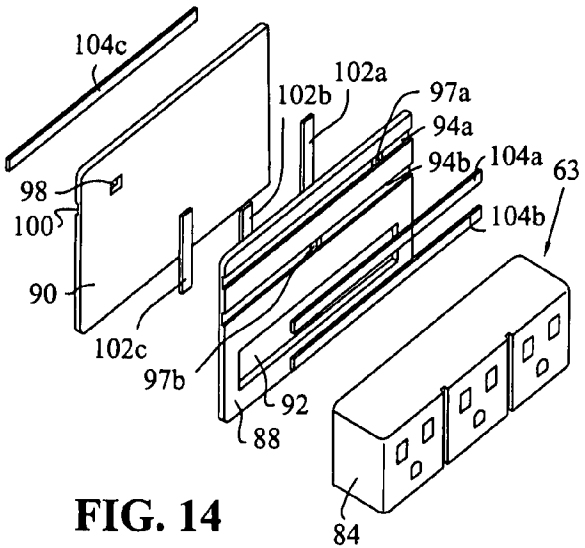
FIG. 14 is an exploded frontal perspective view of the outlet of FIG. 11.
Figure 12:
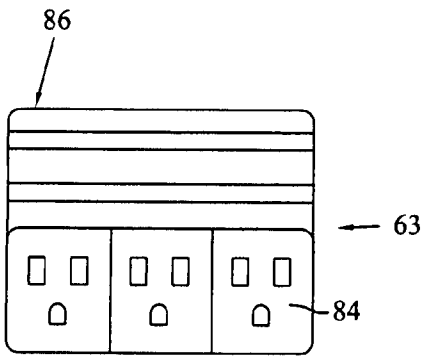
FIG. 12 is a front plan view of the outlet plug of FIG. 11.

Now referring to FIGS. 11-15, the embodiment of plug-in outlet receptacle 63 will be discussed in greater detail. Outlet receptacle 63 includes a body portion 84 configured to receive three standard three-prong electrical plugs (not shown) as is known for providing electrical power to a device (not shown) plugged therein. Outlet receptacle 63 also includes a contactor plug-in portion, generally indicated as 86 for plugging into slot 68. Contactor plug-in portion 86 is comprised of a pair of adjacent panels 88, 90 that are preferably made from a dielectric material, such as ABS plastic, or other material having at least a partial coating of a nonconductive dielectric material. Panel 88 contains an opening 92 and a pair of parallel horizontally extending grooves 94*a*, 94*b* on the front side thereof (FIG. 14) and three vertical generally parallel grooves 96*a*, 96*b*, 96*c* on the back side thereof (FIG. 15). Panel 88 also includes a hole 97*a* through the grooves 94*a* and 96*a* and a hole 97*b* through grooves 94*b* and 96*b*. Panel 90 contains a small hole 98 and a single horizontal groove 100 that intersects hole 98 (FIG. 15). Electrical receptacle 63 includes three conductors, 102*a*, 102*b*, 102*c*, sandwiched between panels 88 and 90 and mounted in grooves 96*a*, 96*b*, 96*c*, respectively, similar to the way conductors 82*a*, 82*b*, 82*c* are mounted in slot 68 herein. Conductors 102*a*, 102*b*, 102*c* are electrically connected through opening 92 to body portion 84 to provide power to the outlet receptacles contained therein. Outlet receptacle 63 also includes three contactors, 104*a*, 104*b*, 104*c*, wherein contactors 104*a* and 104*b* are mounted in grooves 94*a*, 94*b*, respectively, and contactor 104*c* is mounted in groove 100 in panel 90. When assembled together as shown in FIGS. 11-13, contactor plug portion 86 of outlet receptacle 63 is receivable in slot 68 with the contactors aligned with the conductors so that contactors 104*a*, 104*b*, 104*c* make electrical contact with respective conductors 82*a*, 82*b* and 82*c*. It should also be appreciated that the current is carried from the contactors through respective holes 97*a*, 97*b* and 98 to conductors 102*a*, 102*b*, 102*c* for providing voltage to the plug receptacles in body portion 84.

Figure 16:
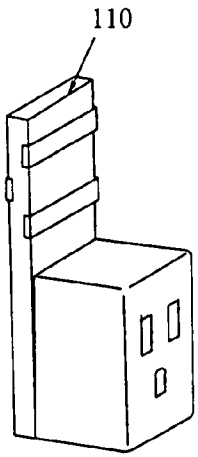
FIG. 16 is a perspective view of an outlet plug similar to that of FIG. 11, except with only one (1) outlet receptacle.
Figure 17:
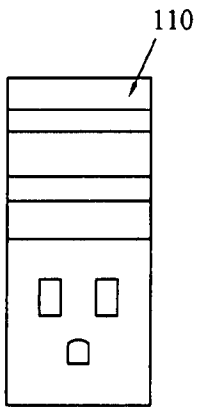
FIG. 17 is a front plan view of the outlet plug of FIG. 16.
Figure 10:
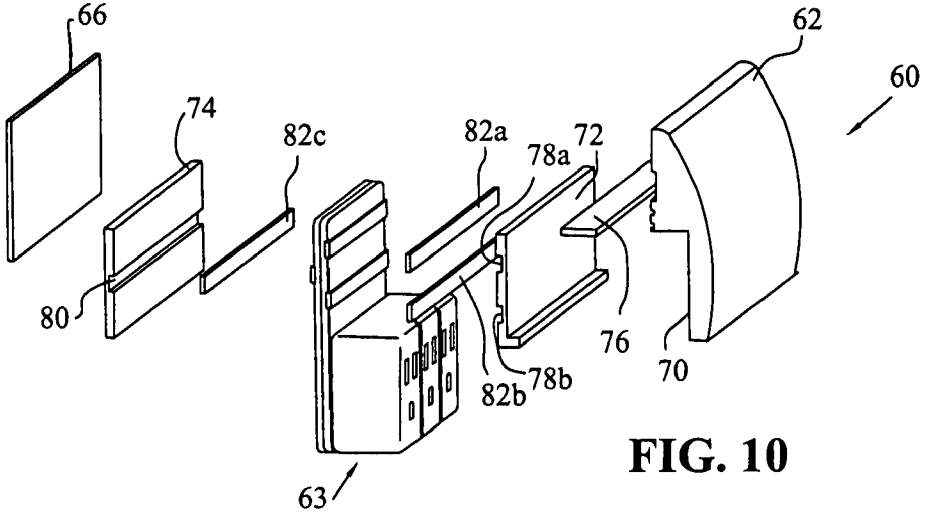
FIG. 10 is an exploded view of the embodiment of FIG. 7.
Figure 9:
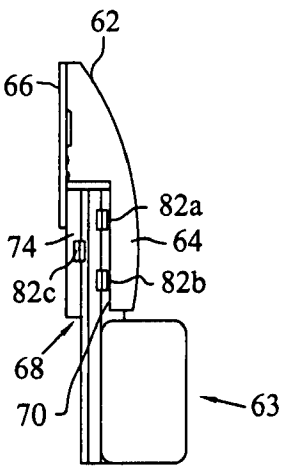
FIG. 9 is a side view of the embodiment of FIG. 7.
Figure 7:
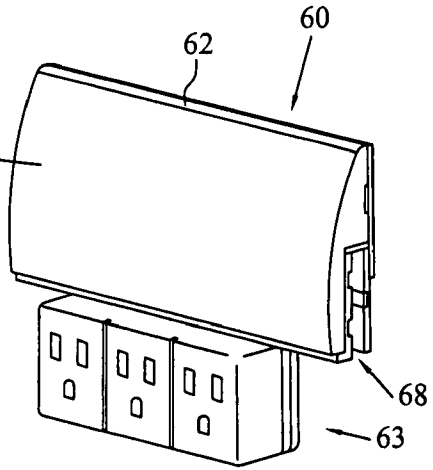
FIG. 7 is a perspective view of another embodiment of the present invention including a chair rail with a slot having continuous electrical conductors for receiving an outlet plug.
Figure 8:
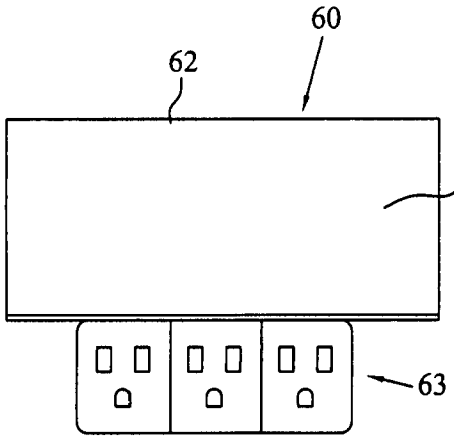
FIG. 8 is a front plan view of the embodiment of FIG. 7.

Now referring to FIGS. 16 and 17, a plug-in outlet receptacle is shown generally indicated as 110. Outlet receptacle 110 is similar in all respects to outlet receptacle 63 except that it contains a single three-prong plug receptacle instead of three as outlet receptacle 63 has.

Figure 18:
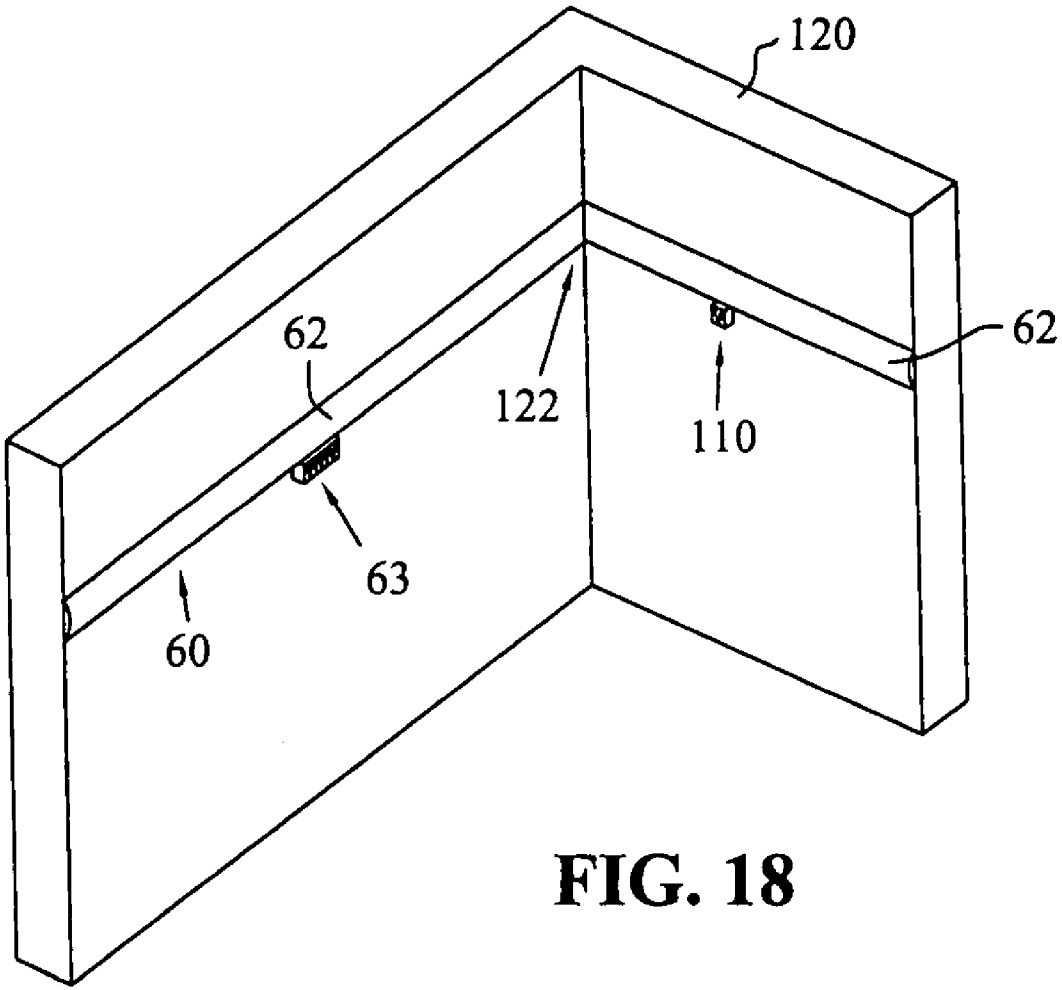
FIG. 18 is a; perspective view of the chair rail of FIG. 7 and outlet plugs of FIGS. 11 and 16 mounted on a wall.
Figure 20:
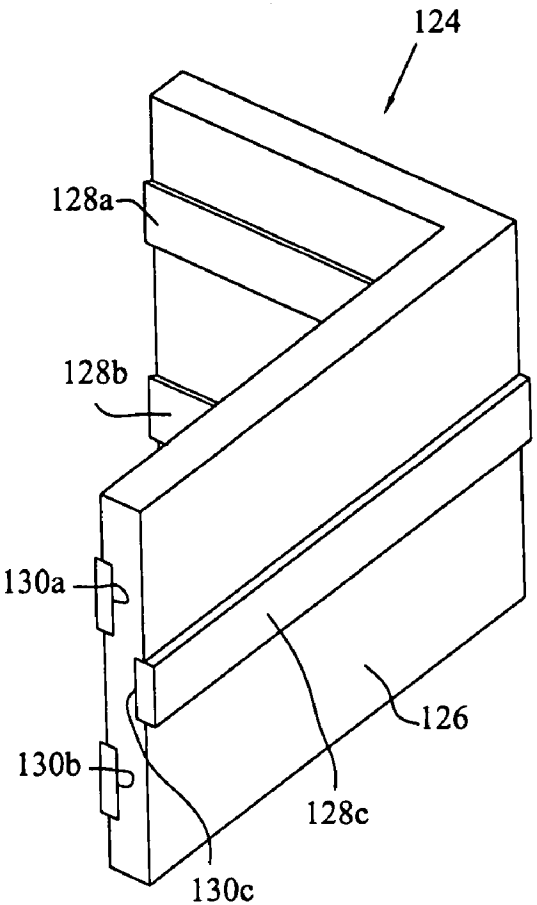
FIG. 20 is a rear perspective view of the corner electrical connector of FIG. 19.
Figure 19:
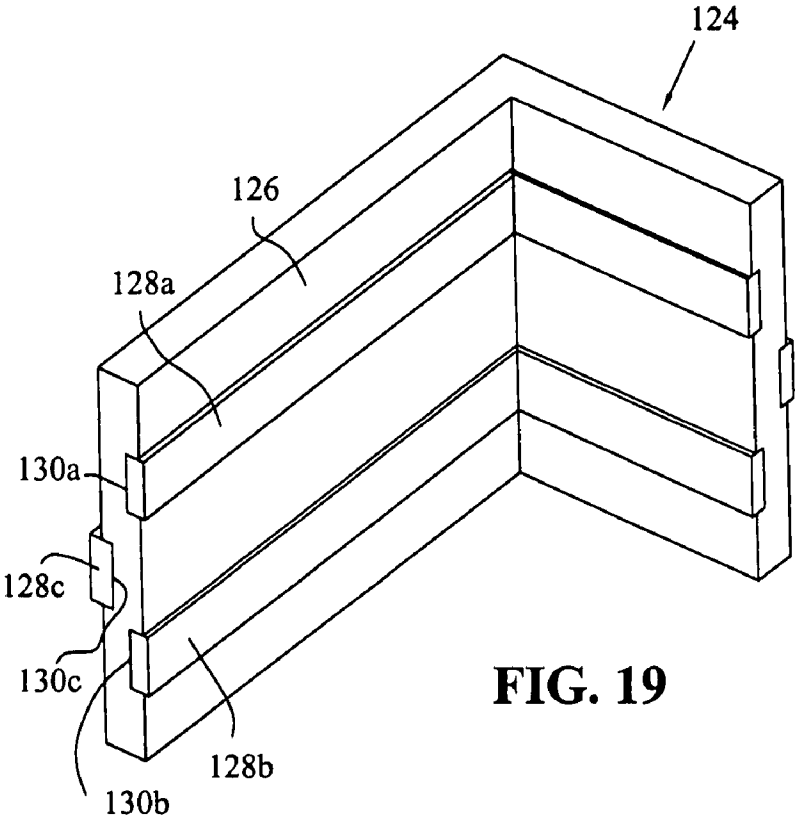
FIG. 19 is a front perspective view of a corner electrical connector for use with the chair rail of FIGS. 7 and 18.
Figures 21, 22, 23, 24:
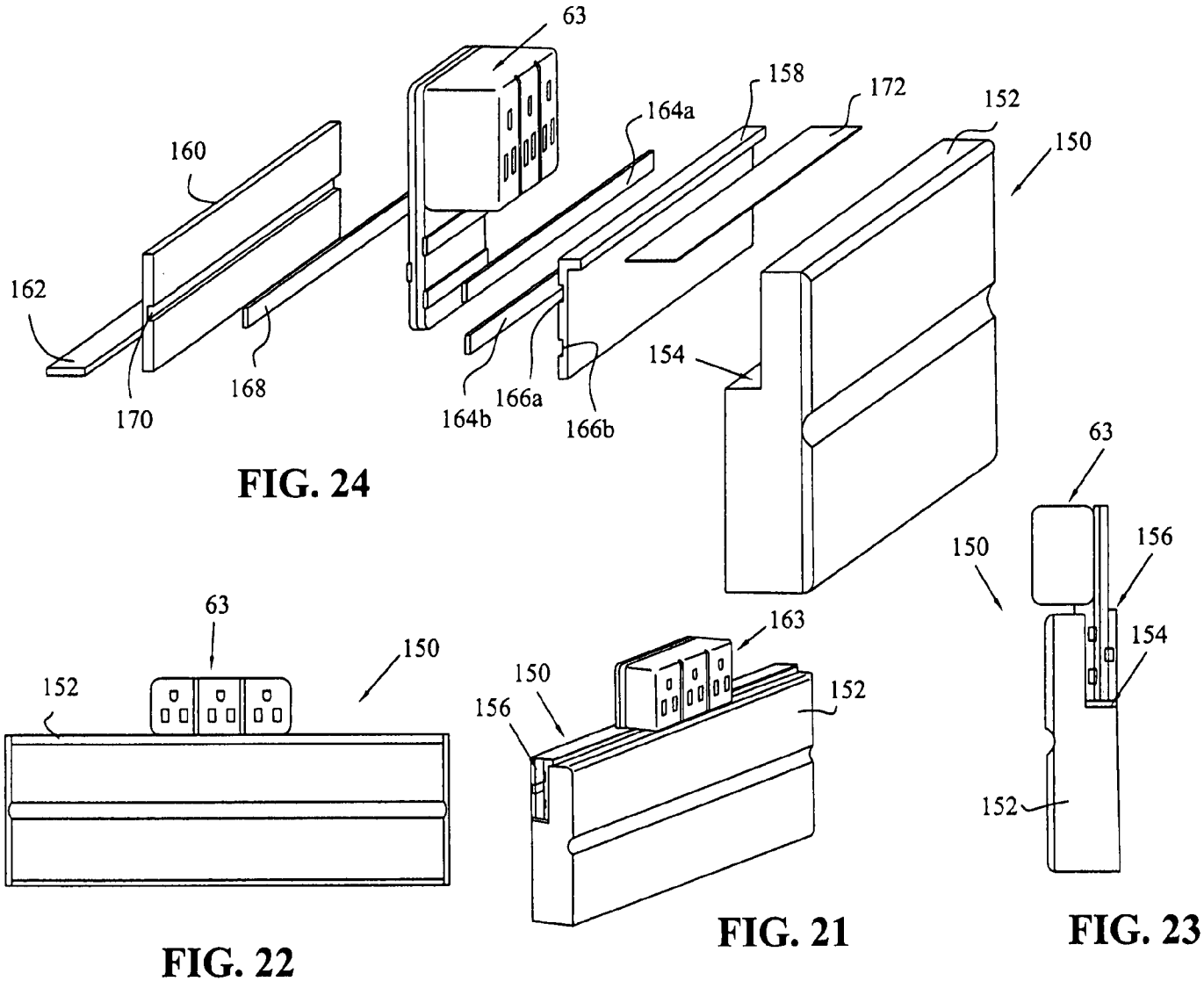
FIG. 21 is a perspective view of a baseboard having a single slot with continuous electrical conductors and a plug-in outlet receptacle similar to that of FIG. 7.
FIG. 22 is a front plan view of the baseboard and plug-in outlet of FIG. 21.
FIG. 23 is a side view of the baseboard and plug-in outlet of FIG. 21.
FIG. 24 is an exploded view of the baseboard of FIG. 21.
Figure 25:
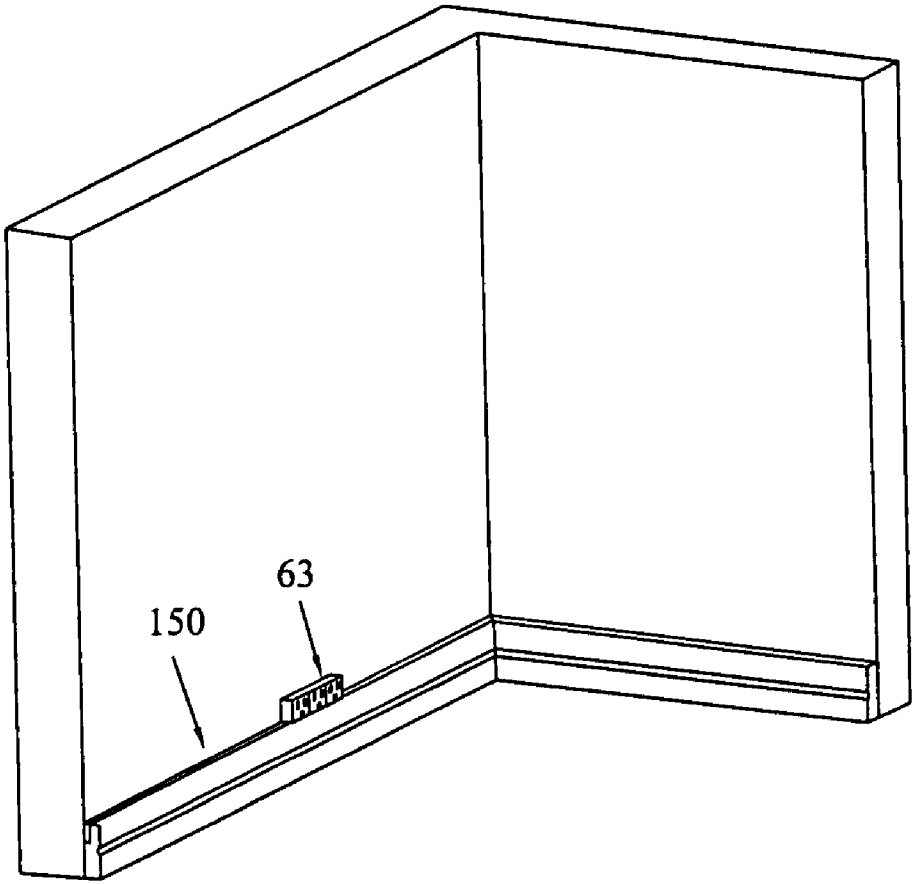
FIG. 25 is a perspective view of the baseboard and plug-in outlet of FIG. 21 mounted on a wall.
Figure 29:
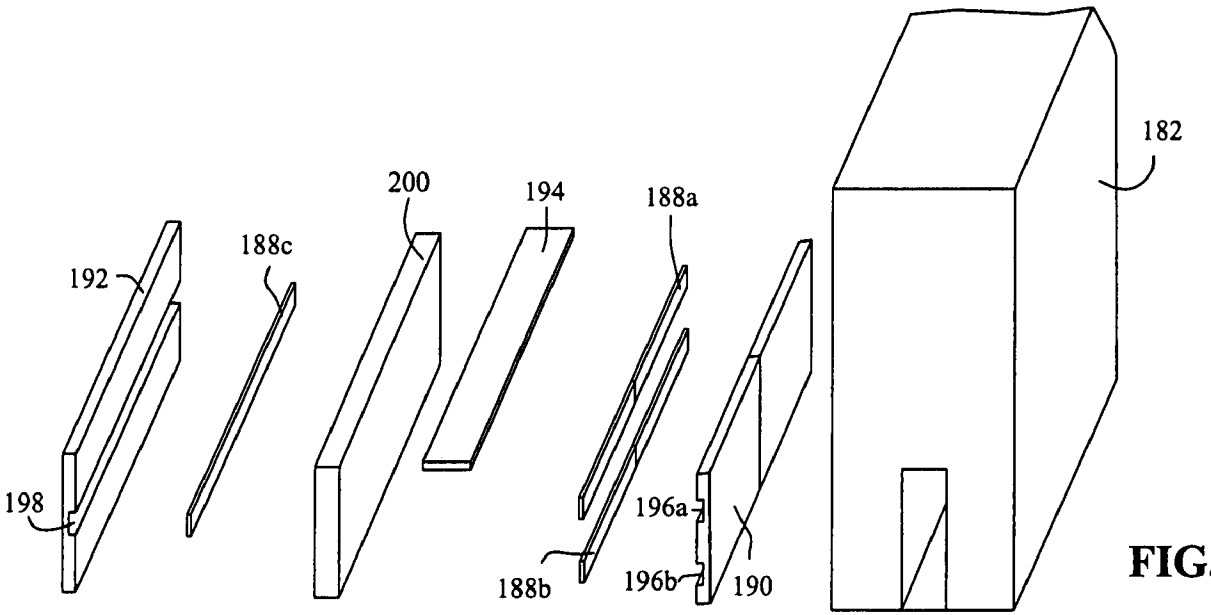
FIG. 29 is an exploded perspective view of the structural/trim member of FIG. 26.
Figure 28:
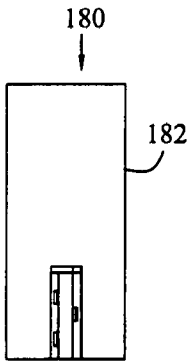
FIG. 28 is a side view of the structural/trim member of FIG. 26.
Figure 26:
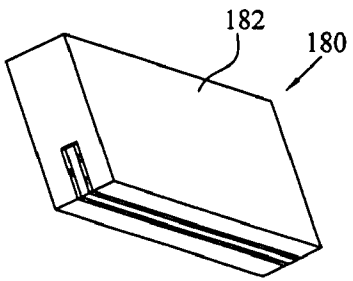
FIG. 26 is a perspective view of a structural or trim member having a slot with electrical conductors mounted therein.
Figure 27:
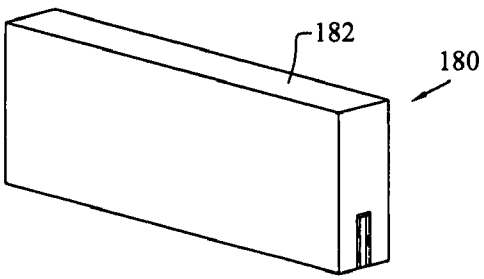
FIG. 27 is a different perspective view of the structural/trim member of FIG. 26.
Figure 31:
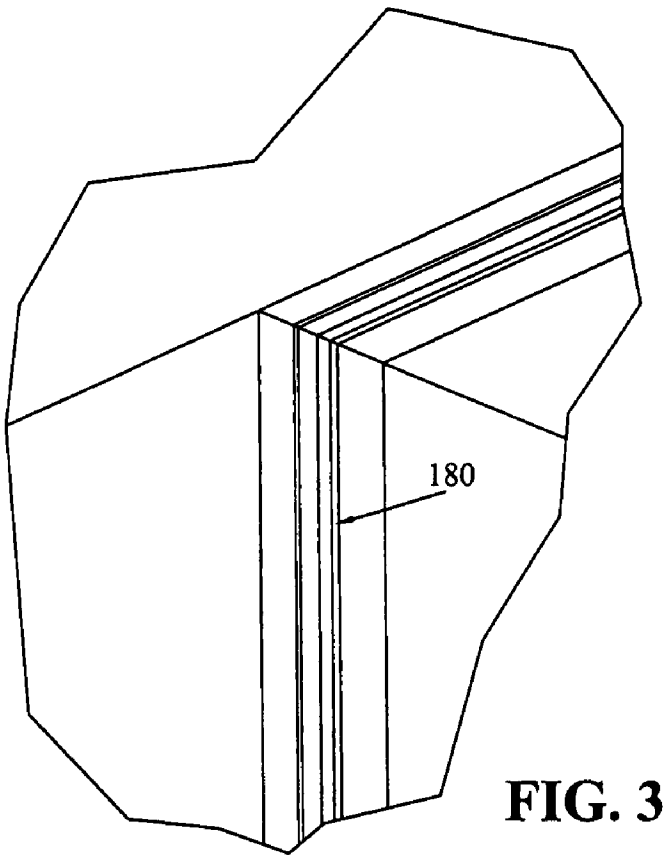
FIG. 31 is a close-up view of a corner of the structural/trim member mounted around the door opening.
Figure 30:
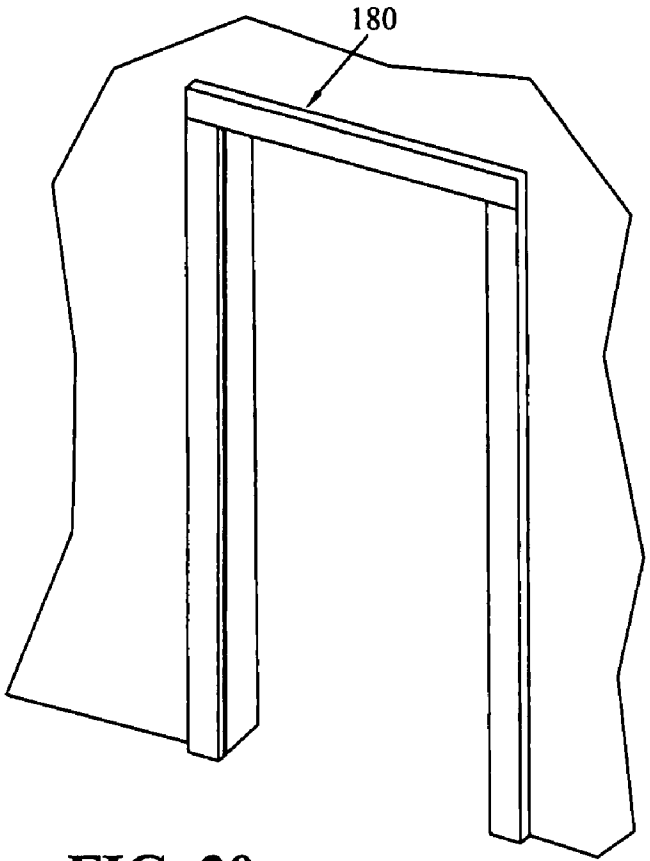
FIG. 30 is a perspective view of the structural/trim member of FIG. 26 mounted around a door opening.

In FIG. 18, electrical distribution board system 60 is shown mounted on a wall structure 120. The electrical distribution board system has one outlet receptacle 63 plugged into slot 68 and one outlet receptacle 110 plugged therein. To make the corner connection generally indicated as 122, a corner connector generally indicated as 124 may be used as shown in FIGS. 19 and 20. Corner connectors 124 include an angled member 126 made from a dielectric material or other material at least partially coated with a nonconductive dielectric material. Corner connector 124 also includes conductors 128*a*, 128*b*, and 128*c* located in grooves 130*a*, 130*b*, 130*c* of angled member 126. As should be apparent, corner connector 124 may be inserted in slots 68 of chair rail members 62, forming corner connection 122 to provide a continuous electrical connection between the respective conductors in adjoining slots 68.

Now referring to FIGS. 21-25, another embodiment of a multifunctional electrical distribution board system is shown generally indicated as 150. Electrical distribution board system 150 is similar in most respects to electrical distribution system 60 except that a base board 152 is provided in lieu of chair rail 62. Base board 152 includes a notched region in the top back portion thereof generally indicated as 154, wherein a slot generally indicated as 156 is located. Slot 156 has a construction similar to slot 68 and includes a front member 158, a rear member 160 and a lower member 162. Horizontally and extending parallel conductors 164*a*, 164*c* are received in grooves 166*b*, 166*b* in front member 158. In addition, a conductor 168 is received in a groove 170 in rear member 160 of slot 156. Slot 156 may also include a sealing member or cover 172 to keep dust and foreign particles out of the slot and as a safety measure to help prevent inadvertent contact by objects with the conductors. Slot 156 may be used to receive and provide power to plug in outlet receptacles 63 or 110, the same as slot 68. It should be appreciated that sealing/cover member 172 may be flexible and contain a slit to receive outlet receptacle 63 or 110 or the sealing or cover member may be partially removed where the outlet receptacle is to be plugged in.

Now referring to FIGS. 26-31, another multifunctional electric distribution board system is generally indicated as 180. Electrical distribution board system 180 includes a structural or trim member 182, which has a slit 184 for receiving a slotted member 186 having electrical conductors 188*a*, 188*b*, 188*c*. Structural trim member 182 is similar to chair rail 62 and base board 152 except that instead of being notched on the backside, it contains slit 184 extending into one of its narrow ends. Likewise, slot member 186 is similar to slots 68 and 156 and includes a front member 190, a rear member 192 and a base member 194. Front member 190 includes grooves 196*a*, 196*b* for mounting conductors 188*a*, 188*b*, respectively, and rear member 192 includes a groove 198 for mounting conductor 188*c*. Front and rear members 190, 192 are preferably made from a dielectric material or at least partially coated in the area where the conductors are mounted with a non-conducted dielectric coating. Electrical distribution board system 180 may be used to receive outlet receptacles such as 63 or 110, or the slot may be filled with a non-conductive material 200, such as foam, in order to use board system 180 as a connection member between two other discreet board systems. Such a use is demonstrated in FIGS. 30 and 31, where distribution board system 180 may be used as trim members around a door opening or a window to connect two or more chair rail boards 62 or base boards 152.

Now referring to FIGS. 32-34, a multifunctional electric distribution board system similar to 180 is generally indicated as 210. System 210 is similar to system 180 except that instead of filling the slotted member with a non-conductive material, a covering 212 is provided over the slot. Covering 212 as well as non-conductive material 200 may be removed from system 210, 180, respectively, to insert a plug-in outlet receptacle therein.

Figure 36:
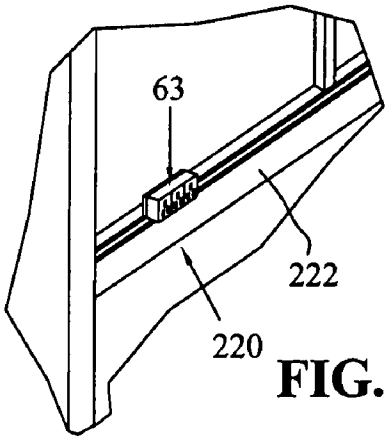
FIG. 36 is a close-up perspective view of the wall and base of FIG. 35.
Figure 36A:
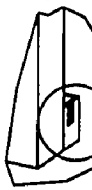
FIG. 36A is a close-up perspective view of the base in FIG. 36 taken where shown.
Figure 36A:
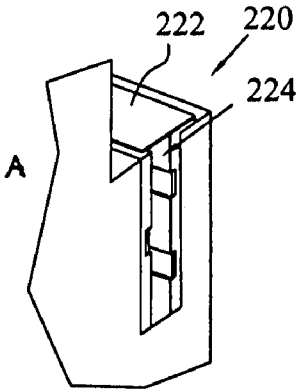
Figure 35:
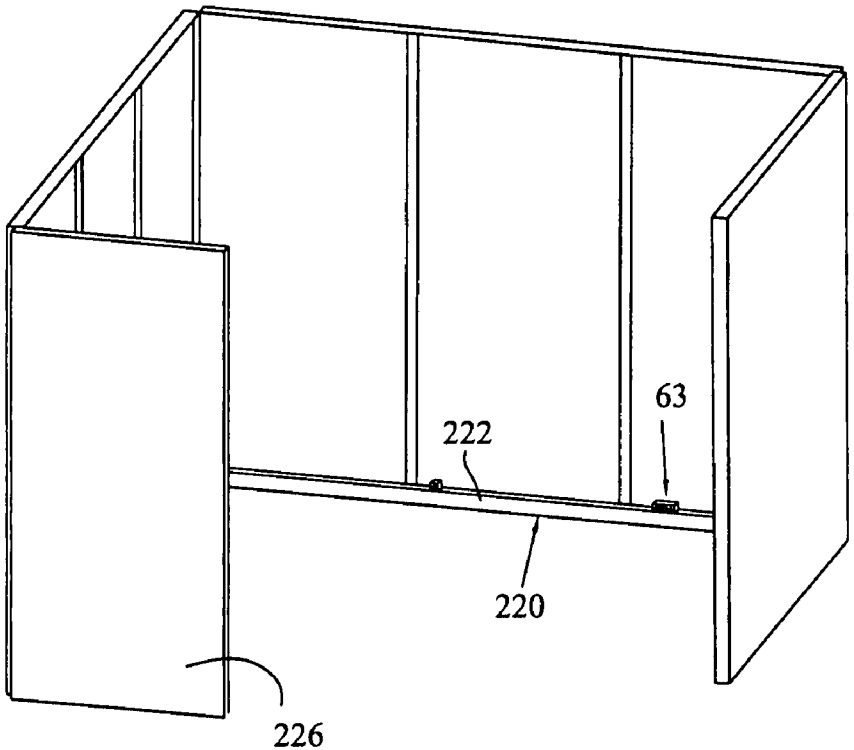
FIG. 35 is a perspective view of a modular wall having a bottom board similar to the baseboard of FIG. 21.

Now referring to FIGS. 35, 36 and 36A, yet another embodiment of a multifunctional electric distribution board system is shown generally indicated as 220. Electrical distribution board system 220 is similar to electrical distribution board system 150, except that it includes a base board 222 having a slot member 224 that is incorporated in a modular wall unit construction 226. A plug-in outlet receptacle 63 is shown plugged into slot 224 in FIG. 36.

Figure 38:
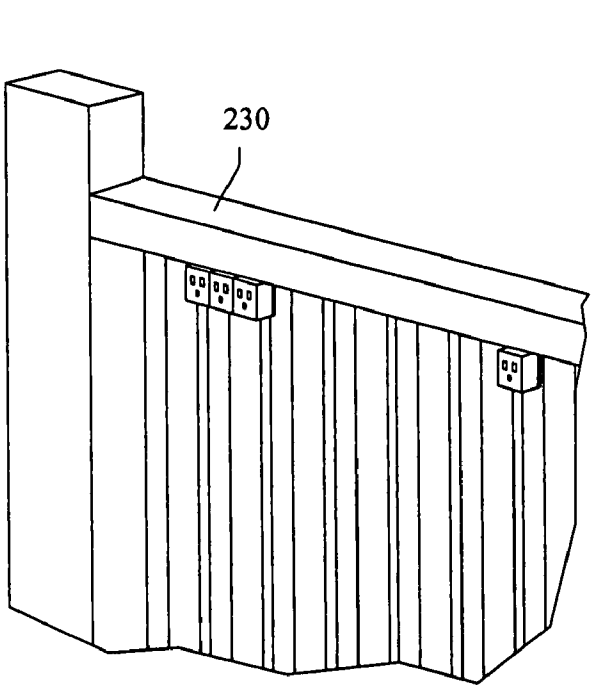
FIG. 38 is a close-up perspective view of the railing and outlet of FIG. 37.
Figure 37:
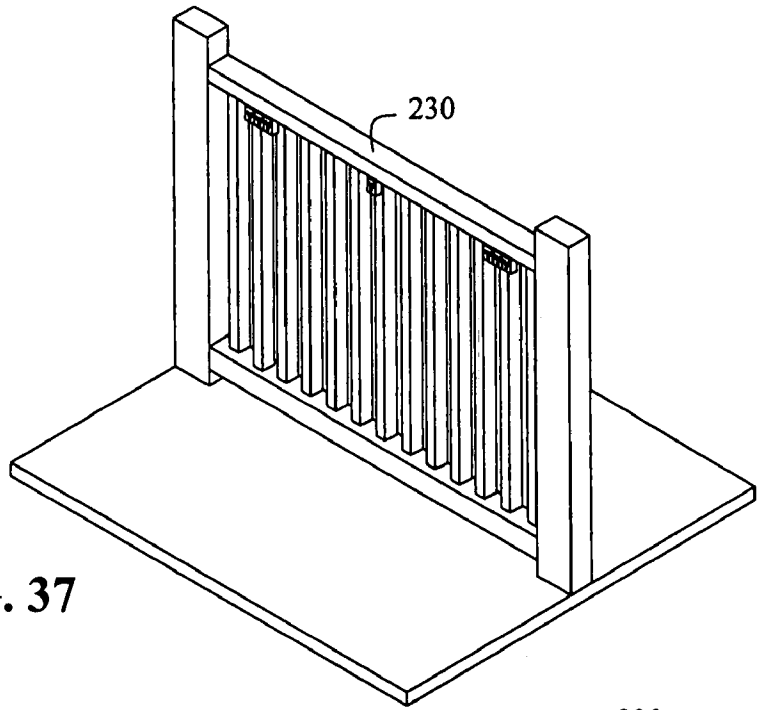
FIG. 37 is a perspective view of a slot and outlet of the present invention mounted on a railing.
Figure 39:
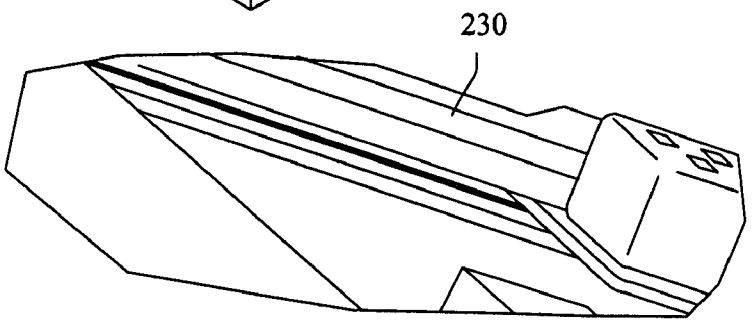
FIG. 39 is a bottom close-up perspective view of the railing and outlet of FIG. 37.

As shown in FIGS. 37-39, the multifunctional electrical distribution board system of the present invention may be incorporated into a rail 230. Such a utilization may be particularly beneficial for a rail such as a deck. If the slot in the rail 230 is positioned downward as shown in FIGS. 37-39, this will assist in helping prevent rain, snow and other debris from accumulating in the slot.

Figure 41:
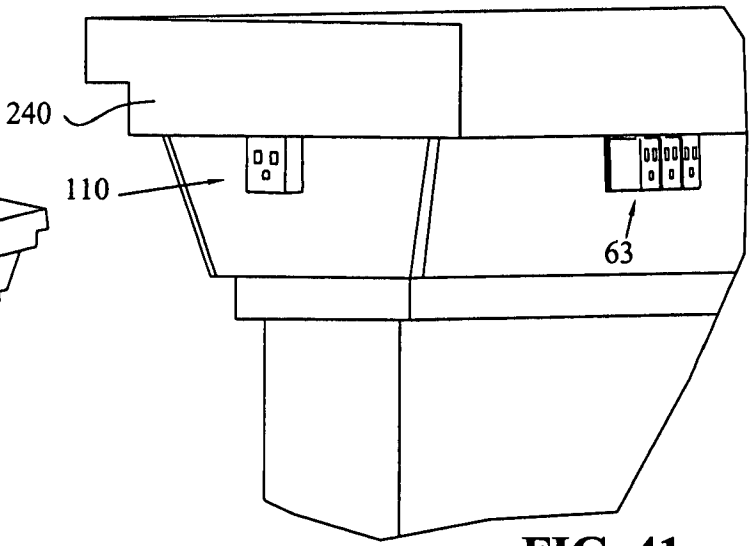
FIG. 41 is a close-up perspective view of the slot and outlet of FIG. 40.
Figure 42:
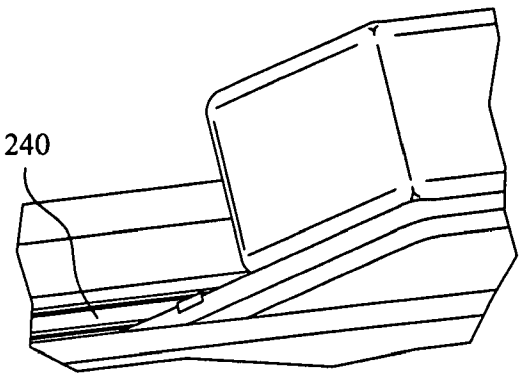
FIG. 42 is a close-up bottom perspective view of the slot and outlet of FIG. 40.
Figure 40:
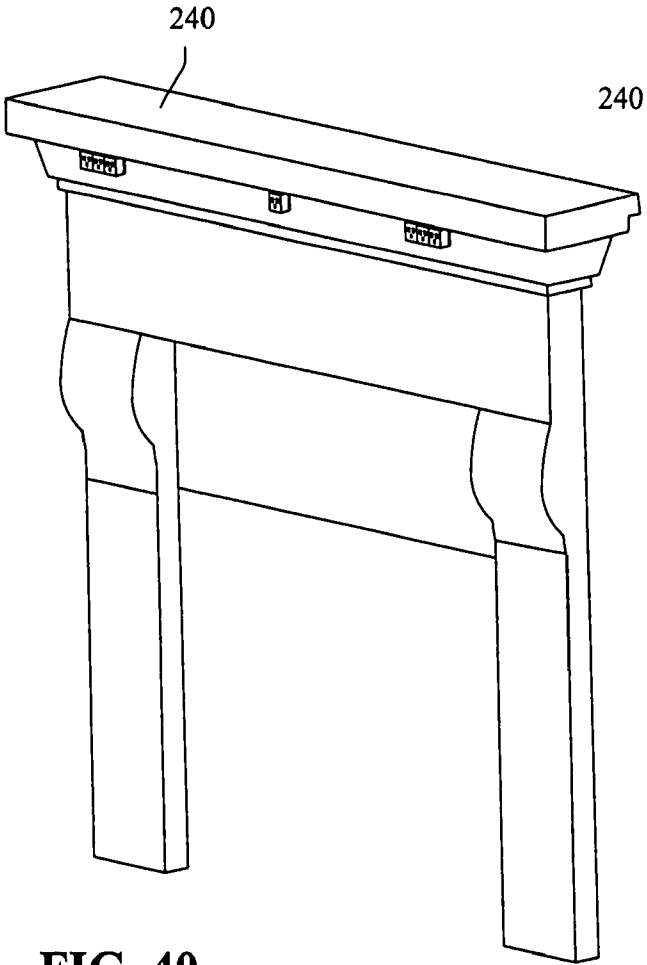
FIG. 40 is a perspective view of a slot and outlet plug of the present invention mounted on a mantle.

Now referring to FIGS. 40-41, it can be seen that the multifunctional electrical distribution board system of the present invention can also be incorporated into other structural or decorative members such as a mantle 240.

Figure 43:
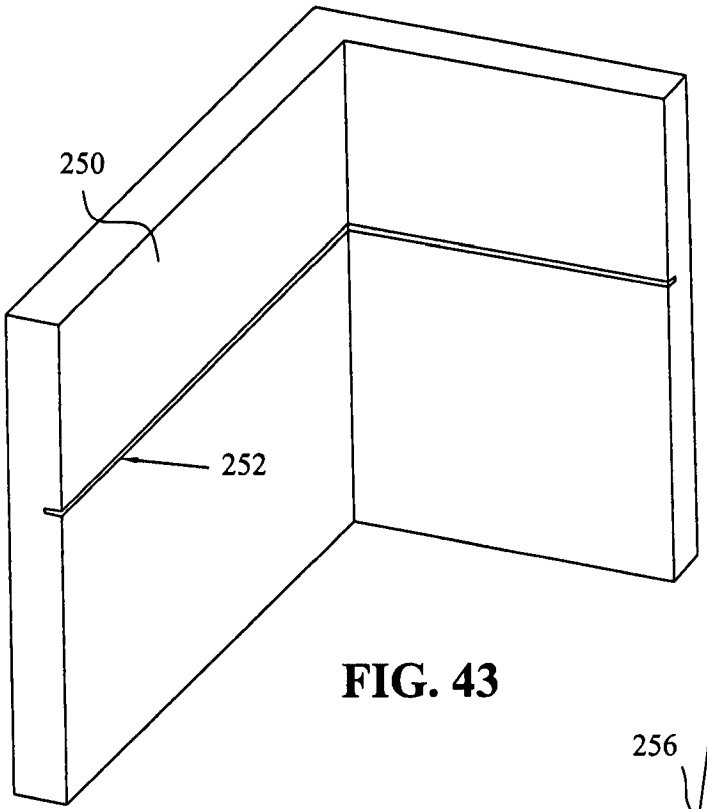
FIG. 43 is a perspective view of a slot of the present invention with continuous conductors mounted directly in a wall.
Figure 44:
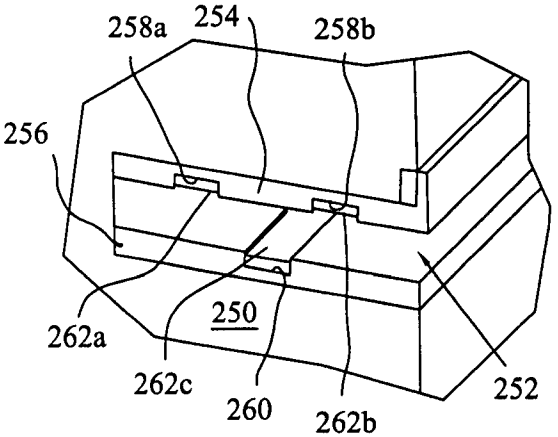
FIG. 44 is a close-up side perspective view of the slot in a wall of FIG. 43.

The multifunctional electrical distribution system of the present invention may also be incorporated directly into the structural or divisional wall member 250 as shown in FIGS. 43 and 44. Walls 250 include a slot generally indicated as 252 that includes an upper member 254 and a lower member 256. The upper member includes a pair of grooves 258*a*, 258*b*, and lower member 256 includes a groove 260. Slot 252 also includes conductors 260*a*, 260*b*, 260*c* mounted in grooves 258*a*, 258*b*, 260, respectively. Upper and lower members 254, 256 may be made from a dielectric material or coated with a non-conductive material in the area of the grooves where the conductors are mounted. As should be evident, slot 252 can receive outlet receptacle 63 and 110 at any location along the length thereof.

While the invention has been taught with specific reference to these embodiments, one skilled in the art will recognize that changes can be made in form and detail without departing from the spirit and scope of the invention. For example, the multifunctional electrical distribution system of the present invention may be incorporated into many other applications such as desks, beds, and other furniture. In addition, the plug-in outlet receptacles may be attached to an extension cord so that the female electrical receptacle is located at the opposite end of the cord from where it is plugged in/mounted into the distribution system slot. Furthermore, electrical devices such as lamps, toasters, coffee makers, computers, etc., may be fitted with a plug configured to be received directly into the slot of the electrical distribution system without the need for a standard two- or three-prong plug.

It should also be realized that the structural or trim member may take on any configuration common for such members and that the slot may be incorporated at any angle or place therein. In addition, additional slots may be added in the distribution board and the number and location of conductors in the slots may be varied for the specific application. As such, the described embodiments are to be considered in all respects only as illustrative and not restrictive. The scope of the invention is, therefore, indicated by the independent claims rather than by the description. All changes that come within the meaning and range of equivalency of the claims are to be embraced within their scope.

What is claimed is:

1. An electrical distribution system comprising:

a structural or trim member having a slot, said slot including at least two continuous electrical conductors, each conductor having an exposed electrical contact surface that extends continuously along substantially the entire length of the slot and is accessible to receive electrical contact anywhere along the length and separated from one another by a dielectric material; and a plug-in outlet receptacle including at least one set of receiving apertures, for receiving an electrical plug and at least two electrical contactors electrically connected to respective apertures for providing electrical power to a device plugged into said outlet receptacle, said contactors configured for receipt into said slot anywhere along the continuous length of the contact surfaces therein, and further configured so that when plugged therein one of said contactors makes electrical contact with one of said continuous conductors, and said other contactor makes electrical contact with said other continuous conductor.

2. The electrical distribution system as set forth in claim 1, further including a corner electrical connector for plugging into slots of two adjacent structural/trim members for providing an electrical connection therebetween.

3. The electrical distribution system as set forth in claim 1, wherein said structural or trim member is selected from a group consisting of a baseboard, a chair rail, a window or door molding/frame, a modular wall, a mantle, a railing, a furniture unit or a structural wall.

4. The electrical distribution system as set forth in claim 1, wherein said conductors extend along opposite sides of said slot.

5. The electrical distribution system as set forth in claim 4, including three conductors with two on one side of said slot and one on the other side of said slot.

6. The electrical distribution system as set forth in claim 1, wherein the contactors of said plug-in outlet receptacle can be plugged into said slot at any desired location along the length thereof.

7. The electrical distribution system as set forth in claim 6, wherein said slot includes three conductors.

8. The electrical distribution system as set forth in claim 1, wherein said contactors are mounted on a dielectric material that is attached to said outlet receptacle.

9. The electrical distribution system as set forth in claim 8, wherein said contactors are parallel to one another and extend in a direction parallel to said conductors in said slot when plugged therein.

10. An electrical distribution system comprising:

at least one structural or trim member having a slot with at least two conductors mounted therein, said conductors having a contact surface and spaced apart by a dielectric material; and a plug-in outlet receptacle having at least one set of receiving apertures for receiving an electrical plug and at least two contactors electrically connected to respective apertures to provide electrical power to a device plugged therein, said contactors configured to be plugged in said slot so that one contactor makes electrical contact with one conductor, and the other contactor makes electrical contact with the other conductor, said plug-in outlet receptacle being movable along the length of said slot to obtain electrical contact while plugged in at different locations along the length therein.

11. The electrical distribution system as set forth in claim 10, including a power control module remotely controlling the electrical power to said outlet receptacle.

12. The electrical distribution system as set forth in claim 10, including three conductors with two conductors located on one side of said slot and one conductor located on the opposite side of said slot.

13. The electrical distribution system as set forth in claim 10, including at least three structural or trim members with one of said structural or trim members being a connection member to electrically connect the other two structural/trim members to one another.

14. The electrical distribution system as set forth in claim 13, wherein said slot of said connection member is filled with a dielectric material.

15. The electrical distribution system as set forth in claim 13, wherein said slot of said connection member has a cover mounted thereover.

16. An electrical distribution system comprising:

a structural or trim member with a slot therein and at least two conductors mounted therein, said conductors each having a contact surface extending continuously along substantially the entire length of the slot creating an extended electrical receptacle running along the slot and spaced apart by a dielectric material, and a plug-in outlet receptacle having at least one set of receiving apertures for receiving an electrical plug from a device to be plugged therein, and at least two contactors electrically connected to respective apertures to provide electrical power thereto, said contactors mounted on a dielectric material as configured to be plugged in and received in said slot so that one contactor makes electrical contact with one conductor and the other contactor makes electrical contact with the other conductor.

17. The electrical distribution system as set forth in claim 16, wherein said contactors are mounted generally parallel to one another on said dielectric material and extend in a direction generally parallel to said conductors in said slot when plugged therein.

18. The electrical distribution system as set forth in claim 16, including a power control module to remotely control power to said outlet receptacle.

19. The electrical distribution system as set forth in claim 16, wherein the outlet receptacle includes an infrared receiver to individually control a device plugged in said outlet receptacle.

20. The electrical distribution system as set forth in claim 16, including three conductors and three contactors.

21. The electrical distribution system as set forth in claim 20, wherein one of said conductors is mounted along an opposite side of said slot from said other two conductors.

22. An electrical distribution system comprising:

a structural trim member a slot therein and at least two conductors mounted therein, said conductors each having a contact surface extending continuously along substantially the entire length of the slot and spaced apart by a dielectric material; and a plug-in member for providing electrical power to a device, said plug-in member having at least two contactors electrically isolated from one another and configured to be plugged in and received in said slot anywhere along the continuous length of the contact surfaces therein so that one contactor makes electrical contact with one conductor, and the other contactor makes electrical contact with the other conductor.

23. The electrical distribution system as set forth in claim 22, wherein the plug-in member includes a body portion and a plug-in portion, the plug-in portion including at least one panel, the contactors being located on the panel.

24. The electrical distribution system as set forth in claim 23, wherein the plug-in member includes receiving bores in the body portion to receive an electrical plug and the panel extends substantially perpendicular to the length of the bores.

25. The electrical distribution system as set forth in claim 23, wherein the panel is plugged into the slot and the contactors extend along the panel in a direction substantially perpendicular to the direction in which the panel is inserted.

26. The electrical distribution system as set forth in claim 23, wherein the plug-in member includes three contactors.

27. The electrical distribution system as set forth in claim 26, wherein two of the contactors are located on one side of the panel and one contactor is located on the other side of the panel.

* * * * *